US006008570A

United States Patent [19]

Helbig et al.

[11] Patent Number: 6,008,570

[45] Date of Patent: Dec. 28, 1999

[54] COMPACT LOW-PRESSURE DISCHARGE LAMP WITH CONDUCTIVE SPRING ELEMENT

[75] Inventors: Peter Helbig, Sontheim; Hermann Steiner, Herbrechtingen; Werner Bernhard, Friedberg, all of Germany

[73] Assignee: Patent-Treuhand-Gesellschaft fuer elektrische Gluehlampen mbH, Munich, Germany

[21] Appl. No.: 09/007,096

[22] Filed: Jan. 14, 1998

[30] Foreign Application Priority Data

Jan. 15, 1997 [DE] Germany ..... 197 01 195

[51] Int. Cl.[6] ..... H01J 5/50

[52] U.S. Cl. ..... 313/318.01; 313/318.12; 439/226; 439/619; 362/226

[58] Field of Search ..... 313/318.02, 318.04, 313/318.08, 318.12; 361/674; 362/226; 439/619, 236, 226

[56] References Cited

U.S. PATENT DOCUMENTS 5,289,079 2/1994 Wittmann ..... 313/318.02
5,320,548 6/1994 Schadhauser ..... 439/236
5,758,952 6/1998 Getselis et al. ..... 362/226
5,864,461 1/1999 Cho ..... 361/674

FOREIGN PATENT DOCUMENTS 0 452 743 A1 10/1991 European Pat. Off. ..... H01J 61/56

*Primary Examiner*—Michael H. Day
*Attorney, Agent, or Firm*—Carlo S. Bessone

[57] ABSTRACT

The invention relates to a compact low-pressure discharge lamp comprising a discharge vessel 14 having electrodes and supply leads 30, and having a lamp cap 12 assembled from a cap 16, housing 18 and mounting plate 24 with a ballast arrangement. In this case, the mounting plate 24 with the ballast arrangement is fitted in the interior of the lamp cap housing 18. The mounting plate 24 also has terminals 26 for the electric connection of the supply leads 30. According to the invention, in this case the supply leads 30 are connected to the electric terminals 26 of the mounting plate 24 via an electrically conducting spring element 28 in each case.

22 Claims, 4 Drawing Sheets

COMPACT LOW-PRESSURE DISCHARGE LAMP WITH CONDUCTIVE SPRING ELEMENT

BACKGROUND OF THE INVENTION

The invention relates to a compact low-pressure discharge lamp comprising a discharge vessel having electrodes and supply leads and having a lamp cap assembled from a cap, housing and mounting plate with a ballast arrangement, the mounting plate with the ballast arrangement being fitted in the interior of the lamp cap housing and having terminals for the electrical connection of the supply leads to the mounting plate.

Known low-pressure discharge lamps are increasingly replacing the incandescent lamp in buildings and residential accommodation. In the known low-pressure discharge lamps, the discharge vessel mostly comprises a singly or multiply bent tube which is arranged in a lamp cap. In this case, a mounting plate constructed as a printed circuit board and on which there is soldered an electronic ballast arrangement is integrated in the lamp cap. Production costs for these compact low-pressure discharge lamps are relatively high, since many complicated manufacturing steps are required in the production. One of these manufacturing steps is the electrical connection between the supply leads of the discharge vessel and the corresponding terminals of the ballast arrangement. In order to produce this connection, the appropriate connecting wires are presently being brought together and, for example, crimped by means of a metal sleeve.

A development of this simple connection is described in EP-A-0 452 743. This printed publication discloses a low-pressure discharge lamp of the type described at the beginning, which has holding pins with the aid of which the ends of the supply leads are aligned perpendicular to the bow-shaped connecting wires of the ballast arrangement. When assembling the lamp cap housing and mounting plate with the lamp cap, the wires which are respectively to make contact are arranged approximately at a right angle one behind another and pressed against one another resiliently with the aid of the holding pin and the inner wall of the lamp cap housing, with the result that an electrical connection is produced between the electrodes of the discharge vessel of the ballast arrangement.

However, it is disadvantageous in this prior art that such an electric connecting system is very complicated. This increases the production costs. In addition, in order to ensure reliable contacting of the elements, the rate of production for such low-pressure discharge lamps is not very high.

SUMMARY OF THE INVENTION

It is therefore the object of the invention to provide a compact low-pressure discharge lamp of the type mentioned at the beginning in which the structure required for an electrical connection between the supply leads of the discharge vessel and the corresponding terminals of the ballast arrangement can be produced simply, quickly and cost effectively while ensuring optimum contact reliability.

The features of the independent claim serve to achieve this object.

Advantageous embodiments are described in the subclaims.

In a compact low-pressure discharge lamp according to the invention, the supply leads of a discharge vessel are connected to the electric terminals of a mounting plate with a ballast arrangement via an electrically conducting spring element in each case. The use of a spring element which on the one hand bears against in each case one supply lead, and on the other hand bears against the corresponding electric terminal of the mounting plate ensures reliable contact is made. Thus, when assembling the lamp cap housing and mounting plate with the lamp cap, the respective spring elements are pressed against the effective spring pressure against both the supply leads and the electric terminals of the mounting plate. According to the invention, only one element is therefore advantageously required to connect the supply leads of the discharge vessel to the corresponding terminals of the mounting plate or of the ballast. The production costs are thereby reduced substantially. In addition, this advantageously results in a substantial increase in the rate of production, since when assembling the lamp cap of the low-pressure discharge lamp the lamp cap housing and lamp cap need only be pressed against one another or screwed.

Before assembling the lamp cap, according to the invention the spring element is received in a spring receptacle constructed on the inner circumference of the cap. For this purpose, the spring receptacle has a cavity for receiving at least one part of the spring element, and is usually of rectangular construction in cross-section. As a result, the spring elements can be mounted independently of the final assembly of the lamp, and this contributes to simplifying the production method and thus lowers the production costs.

In a further advantageous embodiment of the low-pressure discharge lamp according to the invention, a shoulder for supporting an end of the supply lead is constructed in the spring receptacle cavity. On the side opposite the shoulder, a side wall surrounding the cavity has a slot, open towards the free end of the spring receptacle, for receiving the supply lead. According to the invention, these features also contribute to simplifying the lamp production process. Thus, before the final assembly of the lamp cap with the lamp cap housing, the respective end of the supply leads of the discharge vessel is laid over the open slot of the side wall of the spring receptacle. This slot is aligned parallel with a notch in the circumference of the cap, with the result that in a first step the supply lead comes to lie in the notch of the cap. If, now, the spring element is placed onto the end of the supply lead, it presses the end of the supply lead into the cavity of the spring receptacle, the supply lead coming to lie on the shoulder constructed in the cavity and in the slot of the spring receptacle. Since the other end of the spring element is held down by the mounting plate, a reliable electric contact is ensured between the spring element and the supply lead, on the one hand, and the corresponding electric terminals on the mounting plate.

In a further advantageous embodiment of the low-pressure discharge lamp according to the invention, the spring element comprising a spring body and a spring lug constructed in one piece therewith has a slot, which widens outwards like a funnel, on the end of the spring body opposite the spring lug. The spring body is constructed in this case in such a way that it engages into the cavity of the spring receptacle of the cap. This advantageous embodiment of the spring body ensures reliable contacting between the spring body and the supply lead. The funnel-like slot of the spring body acts in this case as a clamping or insulation piercing contact.

In further advantageous embodiments of the low-pressure discharge lamp according to the invention, the spring body has at least one saw-toothed edge or at least one lateral element. Reliable positioning and fastening of the spring element in the cap is ensured by the saw-toothed edge or the additional lateral element, which both engage in the cavity of the spring receptacle. The spring lug opposite the spring body is advantageously multiply bent to produce a spring action. The length of the spring lug is selected in this case so as to ensure reliable contact with the terminal of the mounting plate.

The spring element normally comprises a spring steel tape or consists of a metal alloy which is a good conductor. Reliable contacting on the terminal of the mounting plate is additionally achieved by additionally tin-plating the spring element.

In a further advantageous embodiment of the subject-matter of the invention the supply lead and the spring element or the spring element and the terminal of the mounting plate are constructed in one piece. A further simplification of the production process is possible since the number of the elements making the electrical contact is thereby decreased.

In a further advantageous embodiment of the low-pressure discharge lamp according to the invention, the mounting plate is fastened perpendicular to the longitudinal lamp axis in the interior of the housing. In this case, the mounting plate rests on ribs which are constructed on the inner circumference of the housing and run parallel to the longitudinal lamp axis. The mounting plate is advantageously constructed as a printed circuit board, conductor tracks being constructed on the side facing the discharge vessel, and circuit elements of the ballast arrangement being constructed on the side averted from the discharge vessel. In this case, at least one terminal is constructed as a soldering eyelet for the purpose of making electric contact between the supply lead and the mounting plate. In a further advantageous embodiment, at least one terminal comprises one or more flat soldering surfaces and/or solder tag strips for the purpose of making electric contact between the supply lead and the mounting plate. This simple and space saving structure of the lamp cap ensures that said cap can be kept small overall and can also be produced cost effectively.

Positioning devices are advantageously constructed for positioning the cap and the housing of the lamp cap in the correct position.

BRIEF DESCRIPTION OF THE DRAWINGS

Further details, features, embodiments and advantages result from the following description of a plurality of exemplary embodiments of the subject-matter of the invention, which are represented by drawings, in which.

BEST MODE FOR CARRYING OUT THE INVENTION

Figure 1:
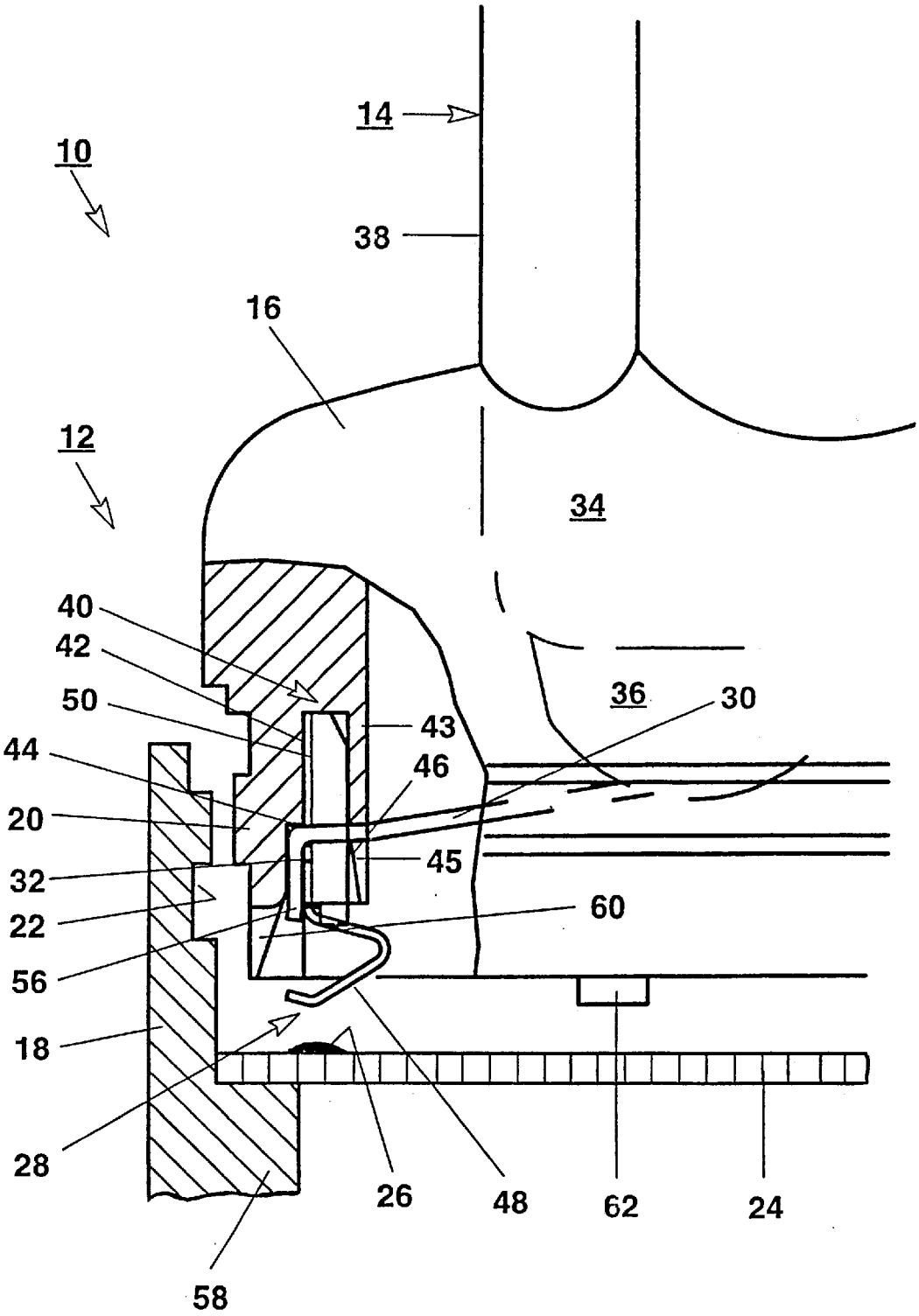
FIG. 1 shows a diagrammatically represented, partially sectioned side view of the low-pressure discharge lamp according to the invention.

Reproduced in FIG. 1 is a partially sectioned side view of a compact low-pressure discharge lamp 10 according to the invention. The lamp 10 comprises in this case a discharge vessel 14 and a lamp cap 12, the lamp cap 12 being assembled from a cap 16 and a housing 18. The lamp cap 12 is constructed in this case essentially in the shape of a cylinder. The cap 16 and the housing 18 are detachably interconnected, at least one positioning device 62 being constructed for connecting the cap 16 and the housing 18 in the correct position. In this case, in the end facing the housing 18 the cap 16 has an annular bead 20 in its outer circumference. The bead 20 engages in this case in a corresponding annular groove 22 in the inner circumference of the housing 18. A secure connection between the two parts is produced by snapping the inner edge of the housing 18 onto the outer edge of the cap 16.

In the interior of the housing 18, which is essentially of cylindrical construction, a mounting plate 24 is fastened perpendicular to the longitudinal lamp axis. The mounting plate 24 is constructed as a printed circuit board, conductor tracks being constructed on the side facing the discharge vessel 14, and circuit elements of the ballast arrangement (not represented) being constructed on the side averted from the discharge vessel. In addition, constructed on the inner circumference of the housing 18 are ribs 58 which run parallel to the longitudinal lamp axis and on whose ends the mounting plate 24 rests.

The discharge vessel 14 normally comprises two or three tube lengths bent in the shape of a U, which are interconnected by a passage (not represented), the end limbs respectively supporting electrodes. The free ends of the tube lengths 38 are sealed in a gas tight fashion by pinches 36 and are seated inside the cap 16 of the lamp cap 12. Supply leads 30 emerge from the discharge vessel 14 in the region of the pinches 36. The supply leads 30 are connected to the electric terminals 26 of the mounting plate 24 via an electrically conducting spring element 28 in each case. The spring element 28 engages in this case in a spring receptacle 40 constructed on the inner circumference of the cap 16, and is fastened detachably therein in the exemplary embodiment shown. The spring receptacle 40 comprises side walls 43, which surround a cavity 42. The cavity 42 serves to receive a part of the spring element 28, and is of rectangular construction in cross-section.

A shoulder 44 for supporting an end 56 of the supply lead 30 is constructed in the cavity 42. On the side of the cavity 42 opposite the shoulder 44, the side wall 43 has a slot 46, open towards the free end of the spring receptacle 40, for receiving the supply lead 30. In addition, the side wall 43 surrounding the cavity 42 has bevels 45 towards the free end of the spring receptacle 40. These bevels 45 facilitate the insertion of the spring element 28. In addition, the cap 16 has at least one notch 60 for supporting the end 56 of the supply lead 30. The notch 60 is aligned in this case parallel to the position of the slot 46. When the lamp 10 is mounted, or when the lamp cap 12 is assembled, the end 56 of the supply lead 30 is laid into the notch 60 of the cap 16 and thereby aligned in the correct position. When the spring element 28 is inserted into the spring receptacle 40, the supply lead 30 is pressed into the cavity 42 until it rests on the shoulder 44 or the end of the slot 46. The spring element 28 in this case has a slot 52 which is widened like a funnel and in which the supply lead 30 is guided. Further details relating to the structure of the spring element 28 follow from FIGS. 4*a* and 4*b* and from FIGS. 5*a* and 5*b*.

On the side facing the discharge vessel 14, the mounting plate 24 has terminals 26 for making electric contact with the supply leads 30 of the ballast arrangement. The terminals 26 can in this case be constructed as a soldering eyelet, or else as flat soldering surfaces and/or solder tag strips which are integrated into the mounting plate 24 or rest thereon.

Figure 2:
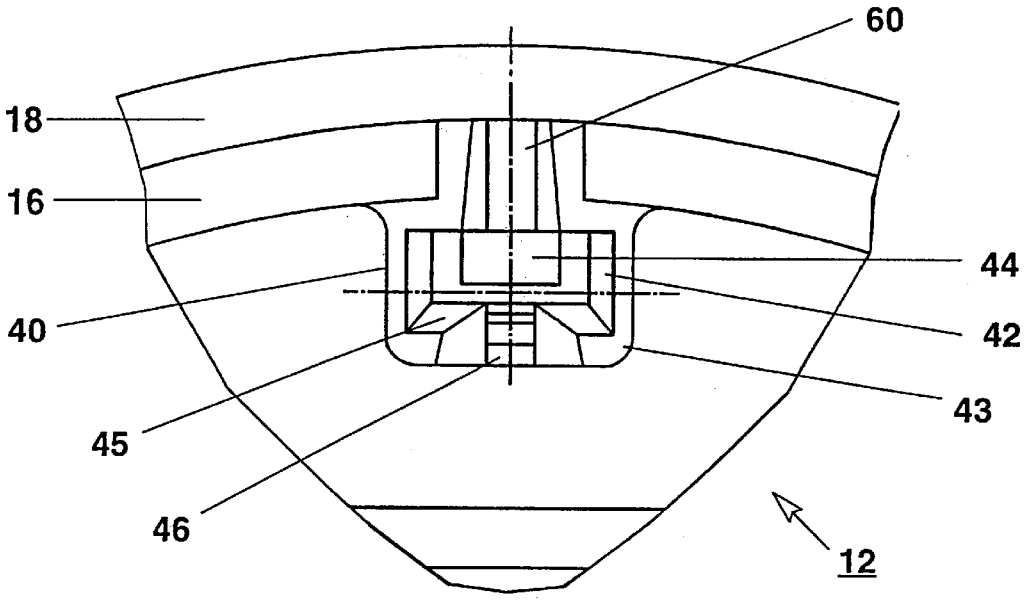
FIG. 2 shows a diagrammatically represented top view of a part of the edge region of the lamp cap of the low-pressure discharge lamp according to the invention.

FIG. 2 shows a top view of a subregion of the edge region of the lamp cap 12. It is to be seen that the free end of the housing 18 is connected to the free end of the cap 16. The spring receptacle 40 is constructed on the inner circumference of the cap 16. The side wall 43 surrounds the cavity 42 in which the shoulder 44 is constructed on the side facing the cap 16 in the outer circumference. The spring receptacle 40 is in this case essentially of rectangular construction in cross-section. In this exemplary embodiment, the cavity 42 has a U-shaped configuration in top view. Also to be seen is the bevel 45 of the lateral wall 43. The parallel position of the slot 46 and of the notch 60, having the same axis, is also well in evidence.

Figure 3A:
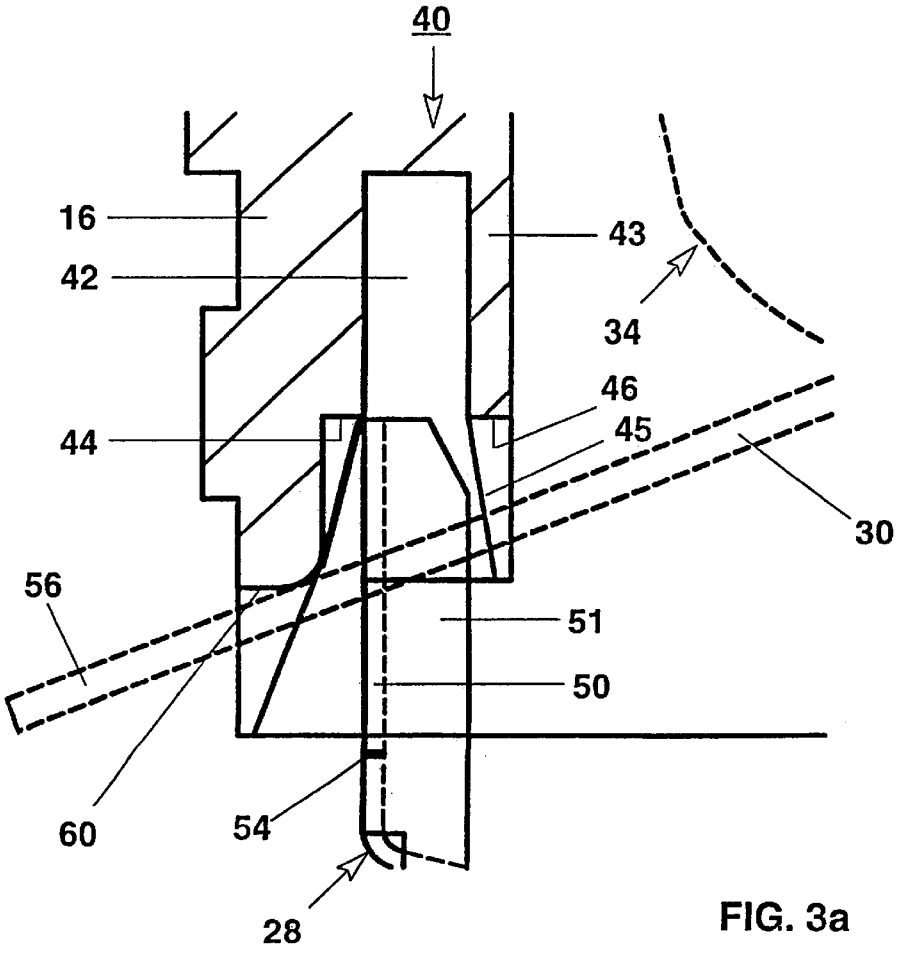
FIGS. 3*a*, 3*b* , and 3*c* respectively show a diagrammatically represented sectional drawing of the edge region of the cap of the low-pressure discharge lamp according to the invention.
Figure 3B:
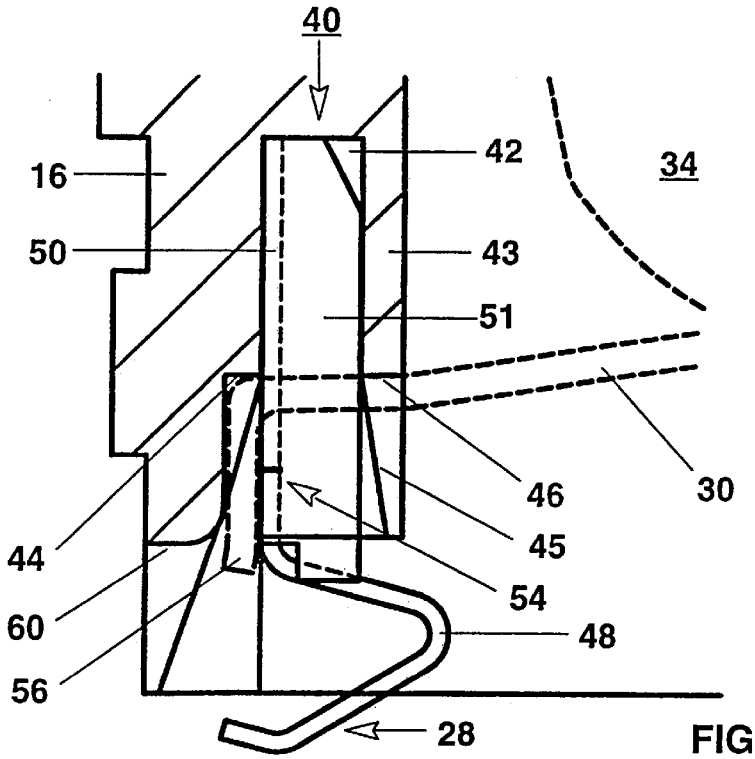
Figure 3C:
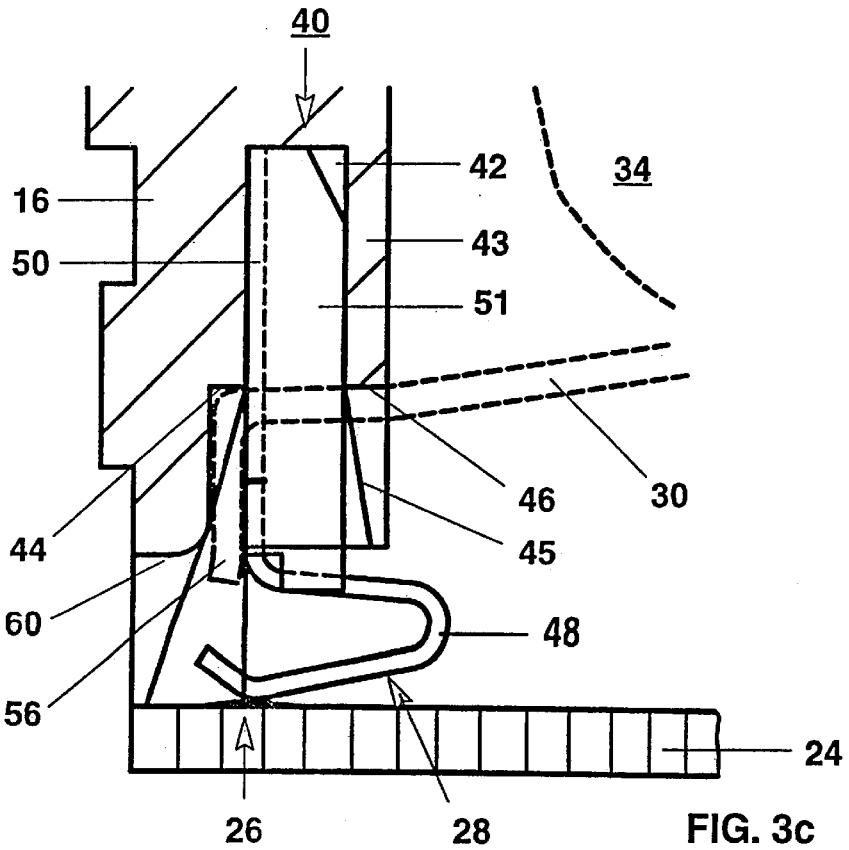

The process of making electric contact between the mounting plate 24 and the supply lead 30 is represented in FIGS. 3*a*–3*c*. Thus, FIG. 3*a* shows that the end 56 of the supply lead 30 rests in the notch 60 in the edge of the cap 16. The spring element 28 is pushed over the supply lead 30, the supply lead 30 being guided in the slot 52 in the spring element 28. The end of the slot 52 is marked by the reference numeral 54.

FIG. 3*b* shows the cap 16 with a spring element 28 inserted fully into the spring receptacle 40. It is to be seen that the free end 56 of the supply lead 30 bears against the inner side of the cap 16 and rests on the shoulder 44. The supply lead 30 fits tight in the slot 46 in the side wall 43 in the direction of the bulb 34. This ensures the supply lead 30 is guided exactly. Since the spring element 28 has a slot 52 of funnel-like construction, it is in intimate contact with the supply lead 30.

FIG. 3*c* shows the cap 16 with the mounting plate 24 placed thereon. It is to be seen that the electric terminal 26 bears against the spring end of the spring element 28. In this case, the mounting plate 24 presses against the spring action of the spring element 28, as a result of which reliable contact therewith is ensured. Via this spring element 28 fastened detachably in the cap 16, a reliable electrical connection is thereby ensured overall between the supply lead 30 and the electrodes, connected thereto, of the discharge vessel 14 and the electric terminal 26 of the mounting plate 24, which supports the ballast arrangement.

Figure 4A:
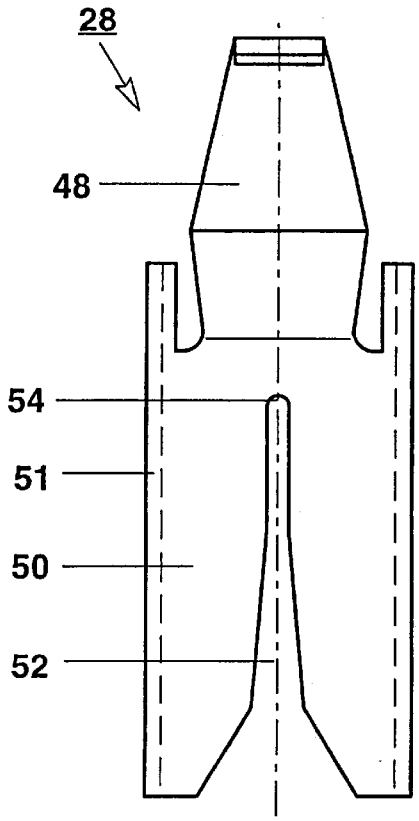
FIGS. 4*a* and 4*b* show diagrammatically represented perspective views of the spring element of the low-pressure discharge lamp according to the invention.
Figure 4B:
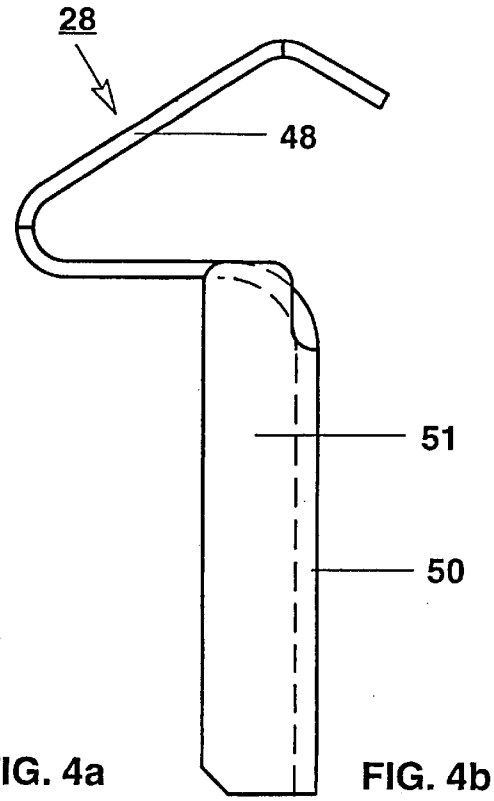

FIGS. 4*a* and 4*b* show the construction of the spring element 28 in a diagrammatic representation. The spring element 28 is represented in this case in a front view in FIG. 4*a*. It is to be seen that the spring element 28 comprises a spring body 50 constructed in one piece with a spring lug 48. The spring body 50 engages in this case in the spring receptacle 40 (compare preceding figures). The spring body 50 can have a saw-toothed edge (not represented), which ensures reliable seating in the cavity 42 in the spring receptacle 40. The spring body 50 has two lateral elements 51 in the exemplary embodiment represented. The lateral elements 51 can be inserted with accurate fit into the cavity 42 in the spring receptacle 40. In addition, on the end opposite the spring lug 48 the spring body 50 has the slot 52 which widens outwards like a funnel. The supply lead 30 is guided in the slot 52, the supply lead 30 being held in the slot 52 by a clamping or piercing action 32. The spring lug 48 is multiply bent to produce a spring action. In this case, the length of the spring lug 48 is selected so as to ensure reliable contact with the terminal 26 of the mounting plate 24.

The spring element 28 comprises a spring steel tape, copper or a metal alloy which is a good conductor. In addition, the spring element can be at least partly tin plated.

FIG. 4*b* shows the spring element 28 in a diagrammatically represented side view. Clearly in evidence is the construction of the lateral element 51 of the spring body 50, and the construction of the spring lug 48.

Figure 5A:
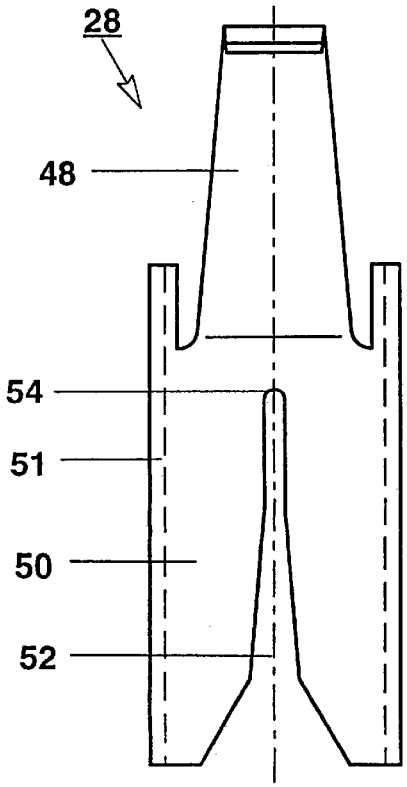
FIGS. 5*a* and 5*b* show diagrammatically represented perspective views of a further embodiment of the spring element of the low-pressure discharge lamp according to the invention.
Figure 5B:
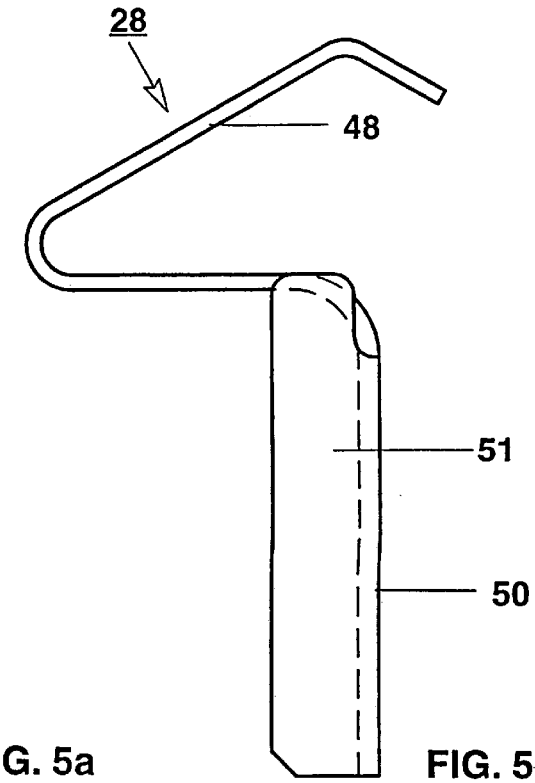

A further embodiment of the spring element 28 is represented in FIGS. 5*a* and 5*b* in a diagrammatically represented front view and a side view, respectively. The different construction of the spring lug 48 is to be seen. In comparison with the exemplary embodiment shown in FIGS. 4*a* and 4*b*, the spring excursion is substantially longer.

It is provided in two further exemplary embodiments (not represented) that either the supply lead 30 and the spring element 28, or the spring element 28 and the terminal 26 of the mounting plate 24 are constructed in one piece.

We claim:

1. A compact low-pressure discharge lamp comprising a discharge vessel (14) having electrodes and supply leads (30) and having a lamp cap (12) assembled from a cap (16), housing (18) and mounting plate (24) with a ballast arrangement, the mounting plate (24) with the ballast arrangement being fitted in the interior of the lamp cap housing (18) and having terminals (26) for the electric connection of the supply leads (30) to the mounting plate (24), characterized in that the supply leads (30) are connected to the electric terminals (26) of the mounting plate (24) via an electrically conducting spring element (28) in each case, the cap (16) has at least one spring receptacle (40) for receiving and detachably fastening the spring element (28) and the spring receptacle (40) is constructed on the inner circumference of the cap (16).

2. The low-pressure discharge lamp according to claim 1, characterized in that the spring receptacle (40) has a cavity (42) for receiving a part of the spring element (28), and is of rectangular construction in cross-section.

3. The low-pressure discharge lamp according to claim 2, characterized in that a shoulder (44) for supporting an end (56) of the supply lead (30) is constructed in the cavity (42).

4. The low-pressure discharge lamp according to claim 3, characterized in that on a side opposite the shoulder (44), a side wall (43) surrounding the cavity (42) has a slot (46), open towards the free end of the spring receptacle (40), for the purpose of receiving the supply lead (30).

5. The low-pressure discharge lamp according to claim 4, characterized in that the side wall (43) surrounding the cavity (42) has bevels (45) towards the free end of the spring receptacle (40).

6. The low-pressure discharge lamp according to claim 4, characterized in that the cap (16) has at least one notch (60) for supporting the end (56) of the supply lead (30), the notch (60) being aligned parallel to the position of the slot (46).

7. The low-pressure discharge lamp according to claim 1, characterized in that the spring element (28) comprises a spring steel tape.

8. The low-pressure discharge lamp according to claim 1, characterized in that the spring element (28) consists of copper or a metal alloy which is a good conductor.

9. The low-pressure discharge lamp according to claim 1, characterized in that the spring element (28) comprises a spring body (50) constructed in one piece with a spring lug (48), the spring body (50) engaging in the spring receptacle (40).

10. The low-pressure discharge lamp according to claim 9, characterized in that the spring body (50) has at least one saw-toothed edge.

11. The low-pressure discharge lamp according to claim 9, characterized in that the spring body (50) has at least one lateral element (51).

12. The low-pressure discharge lamp according to claim 9, characterized in that on the end opposite the spring lug (48), the spring body (50) has a slot (52) widening outwards like a funnel.

13. The low-pressure discharge lamp according to claim 12, characterized in that the supply lead (30) is guided in the slot (52) of the spring element (28) or of the spring body (50).

14. The low-pressure discharge lamp according to claim 9, characterized in that the spring lug (48) is multiply bent to produce a spring action.

15. The low-pressure discharge lamp according to claim 9, characterized in that the length of the spring lug (48) is selected so as to ensure reliable contact with the terminal (26) of the mounting plate (24).

16. The low-pressure discharge lamp according to claim 1, characterized in that the lamp cap (12) is essentially of cylindrical construction.

17. The low-pressure discharge lamp according to claim 1, characterized in that the cap (16) and the housing (18) are detachably connected to one another, at least one positioning device (62) being constructed for connecting the cap (16) and housing (18) in the correct position.

18. The low-pressure discharge lamp according to claim 1, characterized in that the mounting plate (24) is fastened perpendicular to the longitudinal lamp axis in the interior of the housing (18).

19. The low-pressure discharge lamp according to claim 1, characterized in that constructed on the inner circumference of the housing (18) are ribs (58) which run parallel to the longitudinal lamp axis and on whose ends the mounting plate (24) rests.

20. The low-pressure discharge lamp according to claim 1, characterized in that the mounting plate (24) is constructed as a printed circuit board, conductor tracks being constructed on the side facing the discharge vessel (14), and circuit elements of the ballast arrangement being constructed on the side averted from the discharge vessel (14).

21. The low-pressure discharge lamp according to claim 1, characterized in that at least one terminal (26) is constructed as a soldering eyelet for the purpose of making electric contact between the supply leads (30) and the mounting plate (24).

22. The low-pressure discharge lamp according to claim 1, characterized in that at least one terminal (26) comprises one or more flat soldering surfaces and/or solder tag strips for the purpose of making electric contact between the supply leads (30) and the mounting plate (24).

* * * * *